US007938744B2

(12) United States Patent
Umezawa et al.

(10) Patent No.: US 7,938,744 B2
(45) **Date of Patent: *May 10, 2011**

(54) MULTI-PIECE SOLID GOLF BALL

(75) Inventors: Junji Umezawa, Chichibu (JP); Kae Iizuka, Chichibu (JP); Daisuke Arai, Chichibu (JP); Hiroshi Higuchi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 102 days.

This patent is subject to a terminal disclaimer.

(21) Appl. No.: 12/393,086

(22) Filed: Feb. 26, 2009

(65) Prior Publication Data

US 2010/0216574 A1 Aug. 26, 2010

(51) Int. Cl.
*A63B 37/06* (2006.01)

(52) U.S. Cl. ..... 473/373

(58) Field of Classification Search ..... 473/373, 473/374, 376

See application file for complete search history.

(56) References Cited

U.S. PATENT DOCUMENTS

| | | | | |
|---|---|---|---|---|
| 6,071,201 | A | 6/2000 | Maruko | |
| 6,277,924 | B1 | 8/2001 | Hamada et al. | |
| 6,394,912 | B1 | 5/2002 | Nakamura et al. | |
| 6,605,009 | B1 | 8/2003 | Nakamura et al. | |
| 6,642,314 | B2 | 11/2003 | Sone et al. | |
| 7,241,232 | B2 | 7/2007 | Sullivan et al. | |
| 7,294,680 | B2 | 11/2007 | Sone et al. | |
| 7,468,006 | B2 | 12/2008 | Sullivan et al. | |
| 2008/0305891 | A1 | 12/2008 | Isogawa | |
| 2009/0124415 | A1* | 5/2009 | Sullivan et al. | 473/373 |
| 2009/0124417 | A1* | 5/2009 | Sullivan et al. | 473/373 |
| 2010/0004070 | A1* | 1/2010 | Bulpett et al. | 473/376 |
| 2010/0004071 | A1* | 1/2010 | Bulpett et al. | 473/376 |

FOREIGN PATENT DOCUMENTS

| | | | |
|---|---|---|---|
| JP | 7-268132 | A | 10/1995 |
| JP | 11-35633 | A | 2/1999 |
| JP | 11-057070 | A | 3/1999 |
| JP | 2000-229133 | A | 8/2000 |
| JP | 2001-17571 | A | 1/2001 |
| JP | 2002-293996 | A | 10/2002 |
| JP | 3656806 | B2 | 3/2005 |
| JP | 4006550 | B2 | 9/2007 |
| JP | 2008-301985 | A | 12/2008 |

OTHER PUBLICATIONS

U.S. Appl. No. 12/393,083 to Umezawa et al. filed Feb. 26, 2009.
U.S. Appl. No. 12/393,092 to Umezawa et al. filed Feb. 26, 2009.

* cited by examiner

*Primary Examiner* — Raeann Trimiew
(74) *Attorney, Agent, or Firm* — Sughrue Mion, PLLC

(57) ABSTRACT

The invention provides a multi-piece solid golf ball composed of a solid core encased by a cover of one or more layer, which solid core has an inner core layer and an outer core layer. The inner core layer is formed primarily of a thermoplastic resin, has a diameter of from 21 to 38 mm, has a JIS-C cross-sectional hardness of from 60 to 83 at any single point on a cross-section obtained by cutting the inner core layer in half, and has a cross-sectional hardness difference between any two points on the cross-section of within ±5. The outer core layer is formed of a rubber composition made primarily of polybutadiene rubber. The solid core has a diameter of from 35 to 42 mm. The ball has specific relationships between the hardness of the inner core layer 1 mm inside a boundary between the inner core layer and the outer core layer, the hardness of the outer core layer 1 mm outside the boundary, and the surface hardness of the outer core layer. Such a golf ball is able to achieve an increased distance.

4 Claims, No Drawings

MULTI-PIECE SOLID GOLF BALL

BACKGROUND OF THE INVENTION

The present invention relates to a multi-piece solid golf ball having a solid core composed of an inner core layer and an outer core layer, and having one or a plurality of cover layers encasing the core. More particularly, the invention relates to a multi-piece solid golf ball endowed with an excellent flight performance and an excellent spin performance.

To increase the distance traveled by a golf ball and improve the feel of the ball when played, efforts have hitherto been made to design golf balls with a multi-layer structure. Such efforts have led to the disclosure of various multi-piece golf balls in which the core, as well as the cover, has been provided with a two-layer structure. For example, JP-A 11-57070 and the corresponding JP No. 4006550 and U.S. Pat. No. 6,071,201 disclose a multi-piece solid golf ball having an inner core layer made of resin and an outer core layer made of rubber, wherein the inner core layer has a diameter of from 15 to 25 mm and a Shore D hardness of from 55 to 90, and the outer core layer has a JIS-C hardness of from 35 to 75 and a thickness of from 0.5 to 3.0 mm. However, because the inner core layer (center) of this golf ball is hard, the ball has a hard feel on impact and an increased spin rate on full shots.

JP-A 2001-17571 and the corresponding U.S. Pat. No. 6,394,912 describe a golf ball in which the core is composed of a center core made of a thermoplastic resin or a thermoplastic elastomer and having a diameter of from 3 to 18 mm and a Shore D hardness of from 15 to 50, and of an outer core layer having a Shore D hardness near the boundary between the outer core layer and the center core that is from 1 to 15 units harder than the Shore D hardness of the center core. Also, JP-A 2000-229133 and the corresponding JP No. 3656806 and U.S. Pat. No. 6,605,009 disclose a golf ball having a construction composed of an inner core layer, an outer core layer and a cover, wherein the inner core layer is made primarily of resin and has a diameter of from 3 to 15 mm, the outer core layer is formed of a rubber composition, the center core has a Shore D surface hardness which is from 4 to 50 units harder than the innermost side of the outer core layer, and the specific gravities of these layers have been adjusted. However, this golf ball has a small center core and thus lacks a sufficient distance performance.

U.S. Pat. No. 7,241,232 discloses a multi-piece solid golf ball having a multi-layer core in which an inner core layer is formed of a resin such as an ionomer, a polyamide or a polyester elastomer and the outer core layer is formed of a rubber composition, and having an inner cover layer and an outer cover layer composed of specific resins and having certain thicknesses. However, a sufficient distance is not achievable with this golf ball either.

U.S. Pat. No. 7,468,006 discloses a golf ball having an inner core layer and an outer core layer, wherein the outer core layer is formed of a copolymer-based highly saturated ionomer having a Shore D hardness of 45 or more, and the inner core layer is formed of a terpolymer-based highly saturated ionomer having a Shore D hardness of 55 or less. However, in this golf ball, the outer core layer has been set to a higher hardness than the inner core layer and the ball does not have a high initial velocity. As a result, a sufficient distance is not achievable.

JP-A 2008-301985 describes a golf ball having a ball construction of three or more layers in which a center core is made primarily of a thermoplastic resin and has a diameter of from 18 to 35 mm. However, the center core in this golf ball is soft, and so the ball does not have a high initial velocity. As a result, the distance on shots with a driver (W#1) leaves something to be desired.

SUMMARY OF THE INVENTION

It is therefore an object of the present invention to provide a multi-piece solid golf ball having a core with a multilayer construction that enables the distance traveled by the ball on full shots to be increased.

The inventors have conducted extensive investigations, as a result of which they have found that, in a golf ball composed of a solid core encased by a cover, which solid core is a multilayer core having an inner core layer and an outer core layer encasing the inner core layer, owing to the stress concentration associated with deformation on impact by a driver (W#1) or the like that arises in the outer core layer, it is necessary to use in the outer core layer a material which has a high resilience and a large hardness distribution and readily deforms. At the same time, the inventors have found that, by using in the inner core layer a material which is relatively large and hard and has a high resilience, when the ball is struck with a driver (W#1), it will have a very high rebound and an improved distance.

Accordingly, the invention provides the following multi-piece solid golf balls.

[1] A multi-piece solid golf ball comprising a solid core encased by a cover of one or more layer, which solid core has an inner core layer and an outer core layer, wherein the inner core layer is formed primarily of a thermoplastic resin, has a diameter of from 21 to 38 mm, has a JIS-C cross-sectional hardness of from 60 to 83 at any single point on a cross-section obtained by cutting the inner core layer in half, and has a cross-sectional hardness difference between any two points on the cross-section of within ±5; the outer core layer is formed of a rubber composition made primarily of polybutadiene rubber; the core of the inner core layer and the outer core layer combined has a diameter of from 35 to 42 mm; and, letting (b) represent the JIS-C cross-sectional hardness of the inner core layer 1 mm inside a boundary between the inner core layer and the outer core layer, (c) represent the JIS-C cross-sectional hardness of the outer core layer 1 mm outside the boundary, and (d) represent the JIS-C surface hardness of the outer core layer, the value (c)-(b) is in a range of from −15 to 10 and the value (d)-(b) is in a range of from −10 to 20.

[2] The multi-piece solid golf ball of [1], wherein the inner core layer is formed primarily of a resin composition obtained by mixing:

100 parts by weight of a base resin of (A-I) from 100 to 30 wt % of an olefin-unsaturated carboxylic acid-unsaturated carboxylic acid ester random terpolymer and/or a metal salt thereof and (A-II) from 0 to 70 wt % of an olefin-unsaturated carboxylic acid random copolymer and/or a metal salt thereof, (B) from 5 to 170 parts by weight of a fatty acid or fatty acid derivative having a molecular weight of from 280 to 1500, and (C) from 0.1 to 10 parts by weight of a basic inorganic metal compound capable of neutralizing acid groups within components A and B.

[3] The multi-piece solid golf ball of [1], wherein the polybutadiene rubber used in the outer core layer rubber composition is synthesized with a rare-earth catalyst.

[4] The multi-piece solid golf ball of [1], wherein the outer core layer rubber composition includes an organic peroxide having a half-life at 155° C. of from 5 to 120 seconds in an amount of from 0.2 to 3 parts by weight per 100 parts by weight of the base rubber.

DETAILED DESCRIPTION OF THE INVENTION

The invention is described more fully below.

The multi-piece solid golf ball of the invention, while not shown in an accompanying diagram, is composed of a solid core encased by one or more cover layer. The solid core is composed of an inner core layer and an outer core layer.

In the present invention, the inner core layer, instead of being formed of a rubber composition as in prior-art golf balls, is formed primarily of a thermoplastic resin. The thermoplastic resin, while not subject to any particular limitation, is exemplified by nylons, polyarylates, ionomer resins, polypropylene resins, polyurethane-based thermoplastic elastomers and polyester-based thermoplastic elastomers. Preferred use can be made of commercial products such as Surlyn AD8512 (an ionomer resin available from DuPont), Himilan 1706 and Himilan 1707 (both ionomer resins available from DuPont-Mitsui Polychemicals), Rilsan BMNO (a nylon resin available from Arkema) and U-polymer U-8000 (a polyarylate resin available from Unitika).

The method used to obtain the inner core layer may be either a forming or injection molding process, although production by an injection molding process is preferred. Advantageous used may be made of a process in which the above-described thermoplastic resin material is injected into the cavity of a core-forming mold.

It is desirable to use an ionomeric resin, an unneutralized form thereof or a highly neutralized ionomeric resin as the inner core layer material. The ionomeric resin or unneutralized ionomeric resin is preferably a resin composition in which the following resin components A-I and A-II serve as the base resins:

(A-I) an olefin-unsaturated carboxylic acid-unsaturated carboxylic acid ester random terpolymer and/or a metal salt thereof; and (A-II) an olefin-unsaturated carboxylic acid random copolymer and/or a metal salt thereof.

This resin composition is described below.

The olefin-unsaturated carboxylic acid-unsaturated carboxylic acid ester random terpolymer and/or metal salt thereof serving as component A-I has a weight-average molecular weight (Mw) of preferably at least 100,000, more preferably at least 110,000, and even more preferably at least 120,000, but preferably not more than 200,000, more preferably not more than 190,000, and even more preferably not more than 170,000. The weight-average molecular weight (Mw) to number-average molecular weight (Mn) ratio of the copolymer is preferably at least 3, and more preferably at least 4.5, but preferably not more than 7.0, and more preferably not more than 6.5.

Here, the weight-average molecular weight (Mw) and number-average molecular weight (Mn) are values calculated relative to polystyrene in gel permeation chromatography (GPC). A word of explanation is needed here concerning GPC molecular weight measurement. It is not possible to directly take GPC measurements for random copolymers and random terpolymers because these molecules are adsorbed to the GPC column owing to the unsaturated carboxylic acid groups within the molecule. Instead, the unsaturated carboxylic acid groups are generally converted to esters, following which GPC measurement is carried out and the polystyrene-equivalent average molecular weights Mw and Mn are calculated.

Component A-I is an olefin-containing copolymer. The olefin in the component is exemplified by olefins in which the number of carbons is at least 2, but not more than 8, and preferably not more than 6. Illustrative examples of such olefins include ethylene, propylene, butene, pentene, hexene, heptene and octene. Ethylene is especially preferred.

Illustrative examples of the unsaturated carboxylic acid in component A-I include acrylic acid, methacrylic acid, maleic acid and fumaric acid. Acrylic acid and methacrylic acid are especially preferred.

The unsaturated carboxylic acid ester in component A-I may be, for example, a lower alkyl ester of any of the above-mentioned unsaturated carboxylic acids. Illustrated examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The random copolymer used as component A-I may be obtained by random copolymerization of the above ingredients in accordance with a known method. Here, it is recommended that the content of unsaturated carboxylic acid (acid content) included in the random copolymer be generally at least 2 wt %, preferably at least 6 wt %, and more preferably at least 8 wt %, but not more than 25 wt %, preferably not more than 20 wt %, and even more preferably not more than 15 wt %. At a low acid content, the rebound may decrease, whereas at a high acid content, the processability of the material may decrease.

The copolymer of component A-I accounts for a proportion of the overall base resin which is from 100 to 30 wt %, preferably at least 50 wt %, more preferably at least 60 wt %, and even more preferably at least 70 wt %, but preferably not more than 92 wt %, more preferably not more than 89 wt %, and even more preferably not more than 86 wt %.

Illustrative examples of the olefin-unsaturated carboxylic acid-unsaturated carboxylic acid ester random terpolymer serving as component A-I include those available under the trade names Nucrel AN4318, Nucrel AN4319, and Nucrel AN4311 (DuPont-Mitsui Polychemicals Co., Ltd.). Illustrative examples of the metal salts of olefin-unsaturated carboxylic acid-unsaturated carboxylic acid ester random terpolymers include those available under the trade names Himilan AM7316, Himilan AM7331, Himilan 1855 and Himilan 1856 (DuPont-Mitsui Polychemicals Co., Ltd.), and those available under the trade names Surlyn 6320 and Surlyn 8120 (E.I. DuPont de Nemours and Co., Ltd.).

The olefin-unsaturated carboxylic acid-unsaturated carboxylic acid random copolymer and/or metal salt thereof serving as component A-II has a weight-average molecular weight (Mw) of preferably at least 150,000, more preferably at least 160,000, and even more preferably at least 170,000, but preferably not more than 200,000, more preferably not more than 190,000, and even more preferably not more than 180,000. The weight-average molecular weight (Mw) to number-average molecular weight (Mn) ratio is preferably at least 3, and more preferably at least 4.5, but preferably not more than 7.0, and more preferably not more than 6.5.

The copolymer of component A-II accounts for a proportion of the overall base resin which is from 0 to 70 wt %, preferably at least 8 wt %, more preferably at least 11 wt %, and even more preferably at least 16 wt %, but preferably not more than 70 wt %, more preferably not more than 50 wt %, even more preferably not more than 40 wt %, and most preferably not more than 30 wt %.

Illustrative examples of the olefin-unsaturated carboxylic acid random copolymer serving as component A-II include those available under the trade names Nucrel 1560, Nucrel 1525 and Nucrel 1035 (DuPont-Mitsui Polychemicals Co., Ltd.). Illustrative examples of the metal salts of olefin-unsaturated carboxylic acid random copolymers include those available under the trade names Himilan 1605, Himilan 1601, Himilan 1557, Himilan 1705, Himilan 1706 and Himilan N1050H (DuPont-Mitsui Polychemicals Co., Ltd.); those available under the trade names Surlyn 7930 and Surlyn 7920 (E.I. DuPont de Nemours and Co., Ltd.); and those available under the trade names Escor 5100 and Escor 5200 (Exxon-Mobil Chemical).

The metal salts of the copolymers of components A-I and A-II may be obtained by neutralizing some of the acid groups in the random copolymer of above components A-I and A-II with metal ions.

Examples of the metal ions which neutralize the acid groups include $Na^{+}$, $K^{+}$, $Li^{+}$, $Zn^{++}$, $Cu^{++}$, $Mg^{++}$, $Ca^{++}$, $Co^{++}$, $Ni^{++}$ and $Pb^{++}$. Of these, $Na^{+}$, $Li^{+}$, $Zn^{++}$, $Mg^{++}$ and $Ca^{++}$ are preferred, and $Zn^{++}$ and $Mg^{++}$ are especially preferred.

In cases where a metal neutralization product is used in components A-I and A-II, i.e., in cases where an ionomer is used, the type of metal neutralization product and the degree of neutralization are not subject to any particular limitation. Specific examples include 60 mol % zinc (degree of neutralization with zinc) ethylene-acrylic acid copolymers, 40 mol % magnesium (degree of neutralization with magnesium) ethylene-acrylic acid copolymers, 40 mol % magnesium (degree of neutralization with magnesium) ethylene-methacrylic acid-isobutylene acrylate terpolymers, and 60 mol % Zn (degree of neutralization with zinc) ethylene-methacrylic acid-isobutylene acrylate terpolymers.

In addition, to achieve a good rebound, use may be made of a highly neutralized ionomer in which the degree of neutralization has been enhanced by mixing components B and C below with above components A-I and A-II under applied heat.

In the above-described highly neutralized ionomeric resin composition, (B) from 5 to 170 parts by weight of a fatty acid or fatty acid derivative having a molecular weight of from 280 to 1500, and (C) from 0.1 to 10 parts by weight of a basic inorganic metal compound capable of neutralizing acid groups within components A and B may be mixed per 100 parts by weight of the foregoing base resin of components A-I and A-II.

Component B is a fatty acid or fatty acid derivative having a molecular weight of at least 280 but not more than 1500 whose purpose is to enhance the flow properties of the heated mixture. It has a molecular weight which is much smaller than that of component A, and helps to significantly increase the melt viscosity of the mixture. Also, because the fatty acid (or fatty acid derivative) of component B has a molecular weight of at least 280 but not more than 1500 and has a high content of acid groups (or derivative moieties thereof), its addition results in little if any loss of resilience.

The fatty acid or fatty acid derivative serving as component B may be an unsaturated fatty acid or fatty acid derivative having a double bond or triple bond in the alkyl moiety, or it may be a saturated fatty acid or fatty acid derivative in which all the bonds in the alkyl moiety are single bonds. It is recommended that the number of carbon atoms on the molecule be preferably at least 18, but preferably not more than 80, and more preferably not more than 40. Too few carbons may result in a poor heat resistance, and may also set the acid group content so high as to cause the acid groups to interact with acid groups present on the base resin, as a result of which the desired flow properties may not be achieved. On the other hand, too many carbons increases the molecular weight, which may lower the flow properties. In either case, the material may become difficult to use.

Specific examples of fatty acids that may be used as component B include stearic acid, 12-hydroxystearic acid, behenic acid, oleic acid, linoleic acid, linolenic acid, arachidic acid and lignoceric acid. Of these, preferred use may be made of stearic acid, arachidic acid, behenic acid, lignoceric acid and oleic acid.

The fatty acid derivative of component B is exemplified by derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component B include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

In the present invention, the amount of component B used per 100 parts by weight of the base resin is at least 5 parts by weight, preferably at least 20 parts by weight, more preferably at least 50 parts by weight, and even more preferably at least 80 parts by weight, but not more than 170 parts by weight, preferably not more than 150 parts by weight, even more preferably not more than 130 parts by weight, and most preferably not more than 110 parts by weight.

Use may also be made of known metallic soap-modified ionomers (see, for example, U.S. Pat. No. 5,312,857, U.S. Pat. No. 5,306,760 and International Disclosure WO 98/46671) when using above component A.

Component C is a basic inorganic metal compound capable of neutralizing the acid groups in above components A and B. As mentioned in prior-art examples, when components A and B alone, and in particular a metal-modified ionomeric resin alone (e.g., a metal soap-modified ionomeric resin of the type mentioned in the foregoing patent publications, alone), are heated and mixed, as shown below, the metallic soap and unneutralized acid groups present on the ionomer undergo exchange reactions, generating a fatty acid. Because the fatty acid has a low thermal stability and readily vaporizes during molding, it causes molding defects. Moreover, if the fatty acid thus generated deposits on the surface of the molded material, it substantially lowers paint film adhesion. Component C is included so as to resolve such problems.

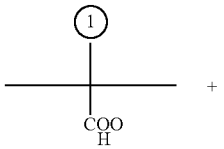

-continued

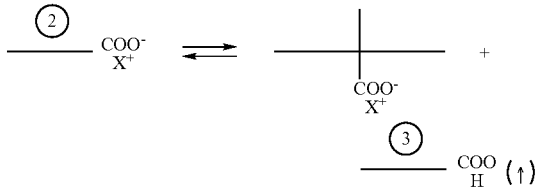

(1) unneutralized acid group present on the ionomeric resin
(2) metallic soap
(3) fatty acid
X: metal atom The heated mixture used in the present invention thus includes, as component C, a basic inorganic metal compound which neutralizes the acid groups present in above components A and B. The inclusion of component C as an essential ingredient confers excellent properties. That is, the acid groups in above components A and B are neutralized, and synergistic effects from the inclusion of each of these components increase the thermal stability of the heated mixture while at the same time conferring a good moldability and enhancing the rebound of the golf ball.

It is recommended that above component C be a basic inorganic metal compound—preferably a monoxide or hydroxide—which is capable of neutralizing acid groups in above components A and B. Because such compounds have a high reactivity with the ionomer resin and the reaction by-products contain no organic matter, the degree of neutralization of the heated mixture can be increased without a loss of thermal stability.

The metal ions used here in the basic inorganic metal compound are exemplified by $Li^{+}$, $Na^{+}$, $K^{+}$, $Ca^{++}$, $Mg^{++}$, $Zn^{++}$, $Al^{+++}$, $Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a monoxide or hydroxide is preferred. The use of magnesium oxide or calcium hydroxide, which have high reactivities with ionomeric resins, is especially preferred.

The above basic inorganic metal compound serving as component C is an ingredient for neutralizing the acid groups in above components A and B and is included in a proportion, based on the acid groups in above components A and B, of preferably at least 30 mol %, more preferably at least 45 mol %, even more preferably at least 60 mol %, and most preferably at least 70 mol %, but preferably not more than 130 mol %, more preferably not more than 110 mol %, even more preferably not more than 100 mol %, still more preferably not more than 90 mol %, and most preferably not more than 85 mol %. In this case, the amount in which the basic inorganic metal compound serving as component C is included may be suitably selected so as to achieve the desired degree of neutralization. The component C in the invention is included in an amount, expressed on a weight basis per 100 parts by weight of the base resin, of preferably from 0.1 to 10 parts by weight, more preferably at least 0.5 part by weight, even more preferably at least 0.8 part by weight, and most preferably at least 1 part by weight, but preferably not more than 8 parts by weight, more preferably not more than 5 parts by weight, and even more preferably not more than 4 parts by weight.

The above resin composition has a melt flow rate, measured in accordance with JIS-K6760 (test temperature, 190° C.; test load, 21 N (2.16 kgf)), of preferably at least 1 g/10 min, more preferably at least 2 g/10 min, and even more preferably at least 3 g/10 min, but preferably not more than 30 g/10 min, more preferably not more than 20 g/10 min, even more preferably not more than 15 g/10 min, and most preferably not more than 10 g/min. If the melt index of this resin mixture is low, the processability of the mixture may markedly decrease.

The method of preparing the above resin mixture is not subject to any particular limitation, although use may be made of a method which involves charging the ionomers or unneutralized polymers of components A-I and A-II, together with component B and component C, into a hopper and extruding under the desired conditions. Alternatively, component B may be charged from a separate feeder. In this case, the neutralization reaction by above component C as the metal cation source with the carboxylic acids in components A-I, A-II and B may be carried out by various types of extruders. The extruder may be either a single-screw extruder or a twin-screw extruder, although a twin-screw extruder is preferable. Alternatively, these extruders may be used in a tandem arrangement, such as single-screw extruder/twin-screw extruder or twin-screw/twin-screw extruder. These extruders need not be of a special design; the use of existing extruders will suffice.

The inner core layer in the present invention has a diameter of from 21 to 38 mm and has a cross-sectional hardness, obtained by cutting the inner core layer in half and measuring the JIS-C hardness at any single point on the cross-section, of from 60 to 83. This cross-sectional hardness (JIS-C) is preferably at least 65, more preferably at least 70, and even more preferably at least 73, but preferably not more than 81, more preferably not more than 79, and even more preferably not more than 78. The cross-sectional hardness between any two points on the cross-section of the inner core layer must be within ±5, and is preferably within ±4, more preferably within ±3, and even more preferably within ±2. By thus making the variance in the cross-sectional hardness of the inner core layer as small as possible, the ball rebound when struck can be made very high and a good feel on impact can be obtained.

The specific gravity of the inner core layer is preferably at least 0.80, more preferably at least 0.85, even more preferably at least 0.90, and most preferably at least 0.92, but is preferably not more than 1.4, more preferably not more than 1.2, even more preferably not more than 1.1, and most preferably not more than 1.0. The specific gravity of the inner core layer, by maintaining the rebound and increasing the moment of inertia, is able to enhance the distance traveled by the ball.

The outer core layer in the present invention is formed of a hot-molded rubber composition composed of polybutadiene as the base rubber.

Here, the polybutadiene has a cis-1,4 bond content of at least 60%, preferably at least 80%, more preferably at least 90%, and most preferably at least 95%.

It is recommended that the polybutadiene have a Mooney viscosity ($ML_{1+4}$ (100° C.)) of at least 30, preferably at least 35, more preferably at least 40, even more preferably at least 50, and most preferably at least 52, but not more than 100, preferably not more than 80, more preferably not more than 70, and most preferably not more than 60.

The term "Mooney viscosity" used herein refers to an industrial indicator of viscosity as measured with a Mooney viscometer, which is a type of rotary plastometer (JIS-K6300). The unit symbol used is $ML_{1+4}$ (100° C.), where "M" stands for Mooney viscosity, "L" stands for large rotor (L-type), "1+4" denotes a pre-heating time of 1 minute and a rotor rotation time of 4 minutes, and "100° C." indicates that measurement was carried out at a temperature of 100° C.

The molecular weight distribution Mw/Mn (where Mw stands for the weight-average molecular weight, and Mn stands for the number-average molecular weight) of the above polybutadiene is at least 2.0, preferably at least 2.2, more preferably at least 2.4, and even more preferably at least 2.6, but not more than 6.0, preferably not more than 5.0, more preferably not more than 4.0, and even more preferably not more than 3.4. If Mw/Mn is too small, the workability may worsen. On the other hand, if it is too large, the rebound may decrease.

The polybutadiene may be synthesized using a nickel or cobalt catalyst, or may be synthesized using a rare-earth catalyst. Synthesis with a rare-earth catalyst is especially preferred. A known rare-earth catalyst may be used for this purpose.

Examples include catalysts obtained by combining a lanthanum series rare-earth compound, an organoaluminum compound, an alumoxane, a halogen-bearing compound and, if necessary, a Lewis base.

In the present invention, the use of a neodymium catalyst containing a neodymium compound as the lanthanum series rare-earth compound is advantageous because it enables a polybutadiene rubber having a high 1,4-cis bond content and a low 1,2-vinyl bond content to be obtained at an excellent polymerization activity. Preferred examples of such rare-earth catalysts include those mentioned in JP-A 11-35633.

When butadiene is polymerized in the presence of a rare-earth catalyst, bulk polymerization or vapor-phase polymerization may be carried out, with or without the use of a solvent. The polymerization temperature may be set to generally between −30° C. and 150° C., and preferably between 10 and 100° C.

Alternatively, the polybutadiene may be obtained by polymerization using the rare-earth catalyst, followed by the reaction of an active end on the polymer with a terminal modifier.

Examples of terminal modifiers and methods for carrying out such a reaction include those described in, for example, JP-A 11-35633, JP-A 7-268132 and JP-A 2002-293996.

The polybutadiene is included in the rubber base in an amount of at least 60 wt %, preferably at least 70 wt %, more preferably at least 80 wt %, and most preferably at least 90 wt %. The upper limit in the amount of polybutadiene included is 100 wt % or less, preferably 98 wt % or less, and more preferably 95 wt % or less. When too little polybutadiene is included in the rubber base, it is difficult to obtain a golf ball having a good rebound.

Rubbers other than the above-described polybutadiene may be included and used together with the polybutadiene, insofar as the objects of the invention are attainable. Illustrative examples include polybutadiene rubbers (BR), styrene-butadiene rubbers (SBR), natural rubbers, polyisoprene rubbers, and ethylene-propylene-diene rubbers (EPDM). These may be used singly or as combinations of two or more thereof.

The hot-molded outer core layer is formed using a rubber composition prepared by blending, as essential ingredients, specific amounts of an unsaturated carboxylic acid or a metal salt thereof, an organosulfur compound, an inorganic filler and an antioxidant with 100 parts by weight of the above-described base rubber.

The unsaturated carboxylic acid is exemplified by acrylic acid, methacrylic acid, maleic acid and fumaric acid. Acrylic acid and methacrylic acid are especially preferred.

Metal salts of unsaturated carboxylic acids that may be used include the zinc and magnesium salts of unsaturated fatty acids, such as zinc methacrylate and zinc acrylate. The use of zinc acrylate is especially preferred.

The amount of unsaturated carboxylic acid and/or metal salt thereof included per 100 parts by weight of the base rubber is preferably at least 20 parts by weight, more preferably at least 22 parts by weight, even more preferably at least 24 parts by weight, and most preferably at least 26 parts by weight, but preferably not more than 45 parts by weight, more preferably not more than 40 parts by weight, even more preferably not more than 35 parts by weight, and most preferably not more than 30 parts by weight. Including too much will result in excessive hardness, giving the ball an unpleasant feel when played. On the other hand, including too little will result in a decrease in the rebound.

An organosulfur compound may optionally be included. The organosulfur compound can be advantageously used to impart an excellent rebound. Thiophenols, thionaphthols, halogenated thiophenols, and metal salts thereof are recommended for this purpose. Illustrative examples include pentachlorothiophenol, pentafluorothiophenol, pentabromothiophenol, p-chlorothiophenol, and the zinc salt of pentachlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

The amount of the organosulfur compound included per 100 parts by weight of the base rubber is preferably at least 0 part by weight, more preferably at least 0.1 part by weight, even more preferably at least 0.2 part by weight, and most preferably at least 0.4 part by weight, but preferably not more than 5 parts by weight, more preferably not more than 4 parts by weight, even more preferably not more than 3 parts by weight, and most preferably not more than 2 parts by weight. Including too much organosulfur compound may excessively lower the hardness, whereas including too little is unlikely to improve the rebound.

The inorganic filler is exemplified by zinc oxide, barium sulfate and calcium carbonate. The amount of the inorganic filler included per 100 parts by weight of the base rubber is preferably at least 5 parts by weight, more preferably at least 6 parts by weight, even more preferably at least 7 parts by weight, and most preferably at least 8 parts by weight, but preferably not more than 80 parts by weight, more preferably not more than 60 parts by weight, even more preferably not more than 40 parts by weight, and most preferably not more than 20 parts by weight. Too much or too little inorganic filler may make it impossible to achieve a suitable weight and a good rebound.

To increase the hardness distribution, it is preferable for the organic peroxide used to be one having a relatively short half-life. Specifically, the half-life at 155° C. (at) is preferably at least 5 seconds, more preferably at least 10 seconds, and even more preferably at least 15 seconds. It is desirable to use an organic peroxide having a half-life at 155° C. (at) of preferably not more than 120 seconds, more preferably not more than 90 seconds, and even more preferably not more than 60 seconds. Examples of such organic peroxides include 1,1-bis(t-hexylperoxy)cyclohexane (trade name, Perhexa HC), 1-1-bis(t-hexylperoxy)-3,3,5-trimethylcyclohexane (trade name, Perhexa TMH), 1,1-bis(t-butylperoxy)-3,3,5-trimethylcyclohexane (trade name, Perhexa 3M) and 1-bis(t-butylperoxy)cyclohexane (trade name, Perhexa C), all of which are available from NOF Corporation. To enable a good rebound and durability to be achieved, it is recommended that the amount of such an organic peroxide included per 100 parts by weight of the base rubber be preferably at least 0.2 part by weight, and more preferably at least 0.3 part by weight, but preferably not more than 3 parts by weight, more preferably not more than 2 parts by weight, even more preferably not more than 1.5 parts by weight, and most preferably not more than 1 part by weight. If the amount included is too high, the rebound and durability may decline. On the other hand, if the amount included is too low, the time required for crosslinking may increase, possibly resulting in a large decline in productivity and also a large decline in compression.

If necessary, an antioxidant may be included in the above rubber composition. Illustrative examples of the antioxidant include commercial products such as Nocrac NS-6 and Nocrac NS-30 (both available from Ouchi Shinko Chemical Industry Co., Ltd.), and Yoshinox 425 (Yoshitomi Pharmaceutical Industries, Ltd.).

To achieve a good rebound and durability, it is recommended that the amount of the antioxidant included per 100 parts by weight of the base rubber be preferably at least 0 part by weight, more preferably at least 0.03 part by weight, and even more preferably at least 0.05 part by weight, but preferably not more than 0.4 part by weight, more preferably not more than 0.3 part by weight, and even more preferably not more than 0.2 part by weight.

Sulfur may also be added if necessary. Such sulfur is exemplified by the product manufactured by Tsurumi Chemical Industry Co., Ltd. under the trade name Sulfur Z. The amount of sulfur included per 100 parts by weight of the base rubber is preferably at least 0 part by weight, more preferably at least 0.005 part by weight, and even more preferably at least 0.01 part by weight, but preferably not more than 0.5 part by weight, more preferably not more than 0.4 part by weight, and even more preferably not more than 0.1 part by weight. By adding sulfur, the core hardness profile can be increased. Adding too much sulfur may result in undesirable effects during hot molding, such as explosion of the rubber composition, or may considerably lower the rebound.

To achieve the subsequently described cross-sectional hardness in the outer core layer (hot-molded piece), the foregoing rubber composition is suitably selected and fabrication is carried out by vulcanization and curing according to a method similar to that used for conventional golf ball rubber compositions. Suitable vulcanization conditions include, for example, a vulcanization temperature of between 100° C. and 200° C., and a vulcanization time of between 10 and 40 minutes. To obtain the desired rubber crosslinked body for use as the core in the present invention, the vulcanizing temperature is preferably at least 150° C., and especially at least 155° C., but preferably not above 200° C., more preferably not above 190° C., even more preferably not above 180° C., and most preferably not above 170° C.

When the outer core layer of the present invention is produced by vulcanizing and curing the rubber composition in the above-described way, advantageous use may be made of a method in which the vulcanization step is divided into two stages: first, the outer core layer material is placed in an outer core layer-forming mold and subjected to primary vulcanization (semi-vulcanization) so as to produce a pair of hemispherical cups, following which a prefabricated inner core layer is placed on one of the hemispherical cups and is covered by the other hemispherical cup, in which state secondary vulcanization (complete vulcanization) is carried out. That is, advantageous use may be made of a method in which production of the solid core is carried out concurrent with formation of the outer core layer. Alternatively, advantageous use may be made of a method in which the outer core layer material is injection-molded over the inner core layer. Forming the outer core layer requires a vulcanization step, which means that the inner core layer is exposed to an elevated temperature. Accordingly, it is desirable for the inner core layer material to have a melting point of at least 150° C.

Here, the inner core layer placed in the hemispherical cups may be pre-coated with an adhesive prior to such placement so as to effect, by means of the adhesive, a firm bond at the interface between the inner core layer and the outer core layer, thereby further enhancing the durability of the golf ball and enabling a high rebound to be achieved. Also, it is recommended that such placement be carried out after roughening the surface of the inner core layer with a barrel finishing machine or the like so as to form fine surface irregularities and thereby increase adhesion between the inner core layer and the outer core layer.

The solid core produced as described above has a diameter, which is the diameter of the core composed of the inner core layer and the outer core layer combined, of from 35 to 42 mm, preferably at least 35.5 mm, and more preferably at least 36 mm, but preferably not more than 41 mm, more preferably not more than 40 mm, and even more preferably not more than 39 mm.

The outer core layer has a specific gravity of preferably at least 1, more preferably at least 1.05, and even more preferably at least 1.1, but preferably not more than 3, more preferably not more than 2.5, even more preferably not more than 2.0, and most preferably not more than 1.5.

In the solid core of the invention, letting (b) represent the JIS-C cross-sectional hardness of the inner core layer 1 mm inside a boundary between the inner core layer and the outer core layer, (c) represent the JIS-C cross-sectional hardness of the outer core layer 1 mm outside the boundary and (d) represent the JIS-C surface hardness of the outer core layer, the value (c)-(b) is −15 or above, preferably −13 or above, more preferably −12 or above, and even more preferably −11 or above. The upper limit value for (c)-(b) is 10 or below, preferably 5 or below, more preferably 2 or below, and even more preferably −1 or below.

The value (d)-(b) is −10 or above, preferably −8 or above, more preferably −6 or above, and even more preferably −4 or above. The upper limit value for (d)-(b) is 20 or below, preferably 15 or below, more preferably 10 or below, and even more preferably 5 or below.

As noted above, by adjusting in the above-described manner the relationship between the cross-sectional hardness (b) at a given place in the inner core layer, the cross-sectional hardness (c) at a given place in the outer core layer and the surface hardness (d) of the outer core layer so as to increase the hardness distribution of the outer core layer and optimize the core deformation when the ball is hit, a good spin and a high rebound can be obtained, enabling the ball to achieve a good flight performance.

The multi-piece solid golf ball of the invention is obtained by forming a cover of one or more layer over the above-described solid core. In the present invention, the cover material is not subject to any particular limitation; the cover may be formed using a known cover material. Specific examples of the cover material include known thermoplastic resins, ionomeric resins, highly neutralized Monomeric resin compositions such as those described above, and thermoplastic and thermoset polyurethanes. Alternatively, use may be made of polyurethane-based, polyamide-based and polyester-based thermoplastic elastomers. Conventional injection molding may be advantageously used to form the cover.

When the cover used in the present invention is relatively soft, in addition to a distance-increasing effect, the spin performance on approach shots improves, thus enabling both controllability and distance to be achieved. When the cover is relatively hard, in addition to a distance-increasing effect, an even lower spin rate can be achieved, enabling the distance to be substantially improved.

In cases where the cover used in the invention is formed so as to be relatively soft, of the above-described cover material, it is preferable to use an ionomeric resin, a highly neutralized ionomeric resin composition, a polyurethane-based thermoplastic elastomer or a polyester-based thermoplastic elastomer. When the cover is composed of a single layer, the cover thickness is at least 0.5 mm, preferably at least 0.6 mm, more preferably at least 0.7 mm, and even more preferably at least 0.8 mm, but not more than 2.0 mm, preferably not more than 1.7 mm, more preferably not more than 1.4 mm, and even more preferably not more than 1.2 mm. Also, the cover hardness, expressed as the Shore D hardness, is set to at least 30, preferably at least 35, more preferably at least 40 and even more preferably at least 45, but not more than 57, preferably not more than 56, and even more preferably not more than 55. Here, "cover hardness" refers to the hardness of the cover material when it has been formed into a sheet of a given thickness.

When the cover is composed of two or more layers, it is preferable for the outer cover layer to be made softer than the inner cover layer. In such a case, the inner cover layer has a thickness of at least 0.5 mm, preferably at least 0.7 mm, more preferably at least 0.9 mm, and even more preferably at least 1.1 mm, but not more than 3.0 mm, preferably not more than 2.7 mm, even more preferably not more than 2.5 mm, and most preferably not more than 2.3 mm. The hardness of the inner cover layer, expressed as the Shore D hardness, is set to at least 51, preferably at least 53, and more preferably at least 55, but not more than 70, preferably not more than 65, more preferably not more than 62, and even more preferably not more than 59.

In cases where the cover used in the invention is formed so as to be relatively hard, it is preferable to use a thermoplastic resin as the cover material. The use of an ionomeric resin is most preferred. When the cover is composed of a single layer, the cover thickness is at least 0.5 mm, preferably at least 0.7 mm, more preferably at least 0.9 mm, and even more preferably at least 1.1 mm, but not more than 3.0 mm, preferably not more than 2.5 mm, more preferably not more than 2 mm, and even more preferably not more than 1.5 mm. Also, the cover hardness, expressed as the Shore D hardness, is set to at least 58, preferably at least 59, and more preferably at least 60, but not more than 70, preferably not more than 65, and even more preferably not more than 63.

When the cover is composed of two or more layers, it is preferable for the outer cover layer to be made harder than the inner cover layer. In such a case, the inner cover layer has a thickness of at least 0.5 mm, preferably at least 0.7 mm, more preferably at least 0.9 mm, and even more preferably at least 1.1 mm, but not more than 3.0 mm, preferably not more than 2.5 mm, even more preferably not more than 2.2 mm, and most preferably not more than 1.9 mm. The hardness of the inner cover layer, expressed as the Shore D hardness, is set to at least 30, preferably at least 35, more preferably at least 40, and even more preferably at least 45, but not more than 57, preferably not more than 56, more preferably not more than 54, and even more preferably not more than 52.

The golf ball diameter should accord with golf ball standards, and is preferably not less than 42.67 mm, and preferably not more than 44 mm, more preferably not more than 43.8 mm, even more preferably not more than 43.5 mm, and most preferably not more than 43 mm. In the above range in the golf ball diameter, the deflection of the ball as a whole when compressed under a final load of 130 kgf from an initial load of 10 kgf (which deflection is also called the "product hardness") is preferably at least 2.3 mm, more preferably at least 2.4 mm, even more preferably at least 2.5 mm, and most preferably at least 2.6 mm, but preferably not more than 5.0 mm, more preferably not more than 4.5 mm, even more preferably not more than 4.0 mm, and most preferably not more than 3.8 mm.

The number of dimples formed on the ball surface is not subject to any particular limitation. However, to increase the aerodynamic performance and extend the distance traveled by the ball, the number of dimples is preferably at least 250, more preferably at least 270, even more preferably at least 290, and most preferably at least 300, but preferably not more than 400, more preferably not more than 380, even more preferably not more than 360, and most preferably not more than 340. The geometric arrangement of the dimples on the ball may be, for example, octahedral or icosahedral. In addition, the dimples are not limited to circular shapes; that is, use may be made of dimples having non-circular shapes such as square, hexagonal, pentagonal or triangular shapes.

As explained above, in the inventive golf ball having an inner core layer and an outer core layer, by making the inner core layer relatively large, using a relatively hard thermoplastic resin as the inner core layer material and using a rubber composition having a large hardness distribution in the outer core layer, a high initial velocity can be maintained on full shots with a driver. In particular, by using a highly neutralized ionomeric resin composition in the inner core layer, the rebound is further enhanced, enabling a golf ball likely to travel an increased distance to be obtained. Moreover, the inventive golf ball is able to achieve a good feel on impact.

EXAMPLES

The following Examples and Comparative Examples are provided by way of illustration and not by way of limitation.

Examples 1 to 7, Comparative Examples 1 to 5

In each example, a resin material formulated as shown in Table 2 below was injected into an injection mold, thereby forming an inner core layer. The core in Comparative Example 1 was composed of a single layer. The inner core layer in Comparative Example 2 was produced by vulcanizing a rubber composition formulated as shown in Table 1.

Next, to create the outer core layer, the rubber composition formulated as shown in Table 1 was kneaded on a roll mill and subjected to primary vulcanization (semi-vulcanization) at 130° C. for 6 minutes to form a pair of hemispherical cups. The inner core layer was enclosed in the pair of hemispherical cups thus obtained and the outer core layer was subjected to secondary vulcanization (complete vulcanization) within the mold at 155° C. for 15 minutes, thereby producing a solid core having a two-layer construction.

Next, the resin materials (cover materials) formulated as shown in Table 2 were injection-molded over the respective solid cores so as to form an inner cover layer. An outer cover layer having on the surface dimples of the same shape, arrangement and number was then formed over the inner cover layer, thereby giving multi-piece solid golf balls having the properties shown in Tables 3 and 4.

TABLE 1

| | A | B | C | D | E | F | G | H | I | J | K | L |
|---|---|---|---|---|---|---|---|---|---|---|---|---|
| Polybutadiene rubber | 100 | 100 | 100 | 100 | 100 | 100 | 100 | 100 | 100 | 100 | 100 | 100 |
| Zinc acrylate | 28.0 | 26.5 | 27.5 | 25.5 | 26.5 | 23.0 | 24.5 | 23.5 | 29.0 | 27.0 | 24.0 | 23.0 |
| Peroxide | 1.2 | 1.2 | 1.2 | 1.2 | 1.2 | 1.2 | 1.2 | 1.2 | 1.2 | 2 | 1.2 | 1.2 |
| Zinc oxide | 5 | 5 | 5 | 5 | 5 | 14.2 | 5 | 5 | 5 | 5 | 5 | 25.9 |
| Barium sulfate | 22.3 | 22.9 | 42.5 | 41 | 40 | 41.7 | 43.5 | 41.7 | 21.9 | 40.3 | 40.9 | 40.2 |
| Antioxidant | 0.1 | 0.1 | 0.1 | 0.1 | 0.1 | 0.1 | 0.1 | 0.1 | 0.1 | 0.1 | 0.1 | 0.1 |
| Zinc salt of pentachloro-thiophenol | 0 | 0 | 0 | 0 | 1.0 | 0 | 0 | 0 | 0 | 0 | 1.0 | 1.0 |

Ingredient amounts shown above are in parts by weight.

Polybutadiene rubber: BR730, available from JSR Corporation. A polybutadiene rubber obtained using a neodymium catalyst; cis-1,4 bond content, 96 wt %; Mooney viscosity, 55; molecular weight distribution, 3.

Zinc acrylate: Available from Nihon Jyoryu Kogyo Co., Ltd.

Peroxide: Perhexa C-40, available from NOF Corporation. 1,1-Bis(t-butylperoxy)cyclohexane diluted to 40% with an inorganic filler. Half-life at 155° C., approximately 50 seconds.

Zinc oxide: Available from Sakai Chemical Industry Co., Ltd.

Barium sulfate: Available from Sakai Chemical Industry Co., Ltd. as Precipitated Barium Sulfate 100.

Antioxidant: Available from Ouchi Shinko Chemical Industry Co., Ltd. as Nocrac NS-6.

TABLE 2

| | Ingredient | No. 1 | No. 2 | No. 3 | No. 4 | No. 5 | No. 6 | No. 7 |
|---|---|---|---|---|---|---|---|---|
| Nucrel AN4319 | A-I | 75 | | 46 | | 75 | | |
| Nucrel N035C | A-I | | 40 | | | | | |
| Surlyn 6320 | A-I | | 60 | | | | | |
| Nucrel N1560 | A-II | 25 | | | | 25 | | |
| Escor 5100 | A-II | | | 60 | | | | |
| Surlyn 8940 | A-II | | | | | | 50 | |
| Surlyn 9945 | A-II | | | | | | 50 | |
| Himilan 1605 | A-II | | | | 69 | | | |
| Dynaron 6100P | | | | | 31 | | | |
| Pandex T8290 | | | | | | | | 25 |
| Pandex T8295 | | | | | | | | 75 |
| Oleic acid | B | 25 | | | | 25 | | |
| Magnesium stearate | B | | 69 | 100 | | | 1.7 | |
| Behenic acid | B | | | | 18 | | | |
| Calcium hydroxide | C | | | | 2.3 | | | |
| Magnesium oxide | C | 3.6 | 0.8 | 2.8 | | 3.6 | | |
| Barium sulfate | | | | | | 18 | | |
| Polytail H | | | | | 2 | | | |
| Polyisocyanate compound | | | | | | | | 9 |
| Thermoplastic elastomer | | | | | | | | 15 |
| Titanium oxide | | | | | | | 2.8 | 3.5 |
| Polyethylene wax | | | | | | | 1 | 1.5 |

Ingredient amounts shown above are in parts by weight.

Nucrel: Ethylene-methacrylic acid-ester random terpolymers or ethylene-methacrylic acid random copolymers available from DuPont-Mitsui Polychemicals Co., Ltd.

Escor 5100: An ethylene-acrylic acid copolymer available from ExxonMobil Chemical.

Surlyn: Ionomers available from DuPont.

Himilan: An ionomeric resin available from DuPont-Mitsui Polychemicals Co., Ltd.

Dynaron 6100P: A hydrogenated polymer available from JSR Corporation.

Pandex: MDI-PTMG type thermoplastic polyurethanes available from DIC Bayer Polymer.

Oleic acid: Available from NOF Corporation as NAA-300.

Magnesium stearate: Available from NOF Corporation as Magnesium Stearate G.

Behenic acid: Available from NOF Corporation under the trade name NAA-222S.

Calcium hydroxide: Available from Shiraishi Calcium Kaisha, Ltd. as CLS-B.

Barium sulfate: Available from Sakai Chemical Industry Co., Ltd. as Precipitated Barium Sulfate 300.

Polytail H: A low-molecular-weight polyolefin polyol available from Mitsubishi Chemical Corporation.

Polyisocyanate compound: 4,4'-Diphenylmethane diisocyanate.

Thermoplastic elastomer: Available from DuPont-Toray Co., Ltd. as Hytrel 4001.

Magnesium oxide: Available from Kyowa Chemical Industry Co., Ltd. as Kyowamag MF150.

Titanium oxide: Available from Ishihara Sangyo Kaisha, Ltd. as Tipaque R550.

Polyethylene wax: Available from Sanyo Chemical Industries, Ltd. as Sanwax 161P.

The following ball properties were investigated for the resulting golf balls. In addition, a flight test was carried out by the method described below, and the feel of the balls on impact was evaluated. The results are shown in Table 3 (Examples of the invention) and Table 4 (Comparative Examples).

Center, Cross-Sectional and Surface JIS-C Hardnesses of Inner Core Layer and Outer Core Layer To obtain the center and cross-sectional hardnesses, the core was cut into hemispheres, the cut face was rendered planar, and measurement was carried out by pressing a durometer indenter perpendicularly against the region to be measured. The results are indicated as JIS-C hardness values.

To obtain the core surface hardness, the durometer was set perpendicular to the surface portion of the spherical core, and the hardness was measured in accordance with the JIS-C hardness standard. The results are indicated as JIS-C hardness values. The measured values were obtained following temperature conditioning at 23° C.

Shore D Hardness of Cover (as a Sheet)

The Shore D hardness of the cover is the value obtained according to ASTM-D-2240 for a 6-mm thick sheet injection-molded from the cover material.

Ball Deformation

Using a model 4204 test system manufactured by Instron Corporation, the ball was compressed at a rate of 10 mm/min, and the difference between the deflection under a load of 10 kg and the deflection under a load of 130 kg was measured.

Distance with W#1

Each ball was struck ten times at a head speed (HS) of 50 m/s with a Tour Stage X-Drive (loft angle, 10.5°) driver (W#1) manufactured by Bridgestone Sports Co., Ltd. mounted on a golf swing robot, and the spin rate (rpm) and total distance (m) were measured. The initial velocity was measured using a high-speed camera.

Feel on Impact

Three top amateur golfers rated the feel of the balls according to the following criteria when struck with a driver (W#1) at a head speed (HS) of 40 to 50 m/s.

Good: Good feel

NG: Too hard or too soft

TABLE 3

| | | | Example | | | | | | |
|---|---|---|---|---|---|---|---|---|---|
| | | | 1 | 2 | 3 | 4 | 5 | 6 | 7 |
| Inner core layer | Material | Type | No. 1 | No. 1 | No. 2 | No. 3 | No. 1 | No. 1 | No. 1 |
| | Diameter | (mm) | 23.4 | 23.4 | 23.4 | 23.4 | 29.2 | 23.4 | 23.4 |
| | Weight | (g) | 6.3 | 6.3 | 6.3 | 6.3 | 12.2 | 6.3 | 6.3 |
| | Center cross-sectional hardness | JIS-C | 76 | 76 | 80 | 79 | 76 | 76 | 76 |
| | Cross-sectional hardness 1 mm inside inner/outer layer interface (b) | JIS-C | 77 | 77 | 81 | 79 | 77 | 77 | 77 |
| Outer core layer | Formulation | Type | C | D | E | E | F | G | H |
| | Diameter | (mm) | 37.3 | 36.5 | 36.5 | 36.5 | 38.3 | 37.3 | 36.5 |
| | Thickness | (mm) | 7.0 | 6.6 | 6.6 | 6.6 | 4.6 | 7.0 | 6.6 |
| | Cross-sectional hardness 1 mm outside inner/outer layer interface (c) | JIS-C | 75 | 74 | 72 | 72 | 67 | 70 | 67 |
| | Surface hardness (d) | JIS-C | 81 | 81 | 79 | 79 | 74 | 77 | 74 |
| | (c) − (b) | JIS-C | −2 | −3 | −9 | −7 | −10 | −7 | −10 |
| | (d) − (b) | JIS-C | +4 | +4 | −2 | 0 | −3 | 0 | −3 |
| Intermediate layer | Material | Type | No. 2 | No. 4 | No. 4 | No. 4 | No. 4 | No. 2 | No. 4 |
| | Hardness | Shore D | 51 | 56 | 56 | 56 | 56 | 51 | 56 |
| | Diameter | (mm) | 40.0 | 40.7 | 40.7 | 40.7 | 40.7 | 40 | 40.7 |
| | Thickness | (mm) | 1.4 | 2.1 | 2.1 | 2.1 | 1.2 | 1.7 | 2.1 |
| Cover | Material | Type | No. 6 | No. 7 | No. 7 | No. 7 | No. 7 | No. 6 | No. 7 |
| | Hardness | Shore D | 62 | 54 | 54 | 54 | 54 | 62 | 54 |
| | Thickness | (mm) | 1.4 | 1.0 | 1.0 | 1.0 | 1.0 | 1.4 | 1.0 |
| Ball | Diameter | (mm) | 42.7 | 42.7 | 42.7 | 42.7 | 42.7 | 42.7 | 42.7 |
| | Weight | (g) | 45.5 | 45.5 | 45.5 | 45.5 | 45.5 | 45.5 | 45.5 |
| | Deformation (10-130 kg) | (mm) | 2.7 | 2.7 | 2.7 | 2.8 | 2.7 | 3.0 | 3.0 |
| W#1 HS 50 | Initial velocity | (m/s) | 72.9 | 73.0 | 73.0 | 72.9 | 73.1 | 72.4 | 72.5 |
| | Carry | (m) | 243.9 | 244.0 | 243.4 | 242.7 | 243.8 | 242.2 | 241.8 |
| | Total | (m) | 261.7 | 260.8 | 260.6 | 260.0 | 260.6 | 260.0 | 259.2 |
| | Feel on impact | | good | good | good | good | good | good | good |

TABLE 4

| | | | Comparative Example | | | | |
|---|---|---|---|---|---|---|---|
| | | | 1 | 2 | 3 | 4 | 5 |
| Inner core layer | Material | Type | A | B | No. 2 | No. 4 | No. 5 |
| | Diameter | (mm) | 36.5 | 23.4 | 23.4 | 23.4 | 38.5 |
| | Weight | (g) | 30.5 | 8.0 | 6.3 | 6.3 | 31.9 |
| | Center cross-sectional hardness | JIS-C | | 62 | 81 | 86 | 78 |
| | Cross-sectional hardness 1 mm inside inner/outer layer interface (b) | JIS-C | | 73 | 81 | 87 | 78 |

TABLE 4-continued

| | | | Comparative Example | | | | |
|---|---|---|---|---|---|---|---|
| | | | 1 | 2 | 3 | 4 | 5 |
| Outer core layer | Formulation | Type | — | I | K | K | L |
| | Diameter | (mm) | — | 36.5 | 36.5 | 36.5 | 41.0 |
| | Thickness | (mm) | — | 6.6 | 6.6 | 6.6 | 1.3 |
| | Cross-sectional hardness 1 mm outside inner/outer layer interface (c) | JIS-C | — | 75 | 65 | 65 | 65 |
| | Surface hardness (d) | JIS-C | — | 82 | 72 | 72 | 72 |
| | (c) − (b) | JIS-C | — | +2 | −16 | −22 | −12 |
| | (d) − (b) | JIS-C | — | +9 | −9 | −15 | −5 |
| Intermediate layer | Material | Type | No. 4 | No. 4 | No. 4 | No. 4 | none |
| | Hardness | Shore D | 56 | 56 | 56 | 56 | — |
| | Diameter | (mm) | 40.7 | 40.7 | 40.7 | 40.7 | — |
| | Thickness | (mm) | 2.1 | 2.1 | 2.1 | 2.1 | — |
| Cover | Material | Type | No. 7 | No. 7 | No. 7 | No. 7 | No. 7 |
| | Hardness | Shore D | 54 | 54 | 54 | 54 | 54 |
| | Thickness | (mm) | 1.0 | 1.0 | 1.0 | 1.0 | 0.85 |
| Ball | Diameter | (mm) | 42.7 | 42.7 | 42.7 | 42.7 | 42.7 |
| | Weight | (g) | 45.5 | 45.5 | 45.5 | 45.5 | 45.5 |
| | Deformation (10-130 kg) | (mm) | 3.0 | 3.0 | 3.2 | 2.45 | 2.3 |
| W#1 | Initial velocity | (m/s) | 72.0 | 71.8 | 72.3 | 73.5 | 73.7 |
| HS 50 | Carry | (m) | 240.0 | 238.9 | 239.9 | 242.7 | 242.6 |
| | Total | (m) | 257.5 | 257.7 | 258.0 | 256.1 | 255.2 |
| | Feel on impact | | good | good | good | NG | NG |

In Comparative Example 1, owing to the use of a single-layer core made of rubber, the ball had a low initial velocity when struck with a driver (W#1), resulting in a poor distance.

In Comparative Example 2, owing to the use of a two-layer core made of rubber, the initial velocity on shots with a driver (W#1) was low, resulting in a poor distance.

In Comparative Example 3, because the outer core layer was soft, the outer core layer cross-sectional hardness (c)—inner core layer cross-sectional hardness (b) value fell outside the range specified for the present invention, as a result of which the ball had a low initial velocity of shots with a driver (W#1) and a poor distance.

In Comparative Example 4, because the inner core layer had a high hardness, the feel on impact was hard and the spin rate on shots with a driver (W#1) increased, resulting in a shorter distance.

In Comparative Example 5, because the inner core layer had a large diameter, the feel on impact was hard and the spin rate on shots with a driver (W#1) increased, resulting in a shorter distance.

The invention claimed is:

1. A multi-piece solid golf ball comprising a solid core encased by a cover of one or more layer, which solid core has an inner core layer and an outer core layer, wherein the inner core layer is formed primarily of a thermoplastic resin, has a diameter of from 21 to 38 mm, has a JIS-C cross-sectional hardness of from 60 to 83 at any single point on a cross-section obtained by cutting the inner core layer in half, and has a cross-sectional hardness difference between any two points on the cross-section of within ±5; the outer core layer is formed of a rubber composition made primarily of polybutadiene rubber; the core of the inner core layer and the outer core layer combined has a diameter of from 35 to 42 mm; and, letting (b) represent the JIS-C cross-sectional hardness of the inner core layer 1 mm inside a boundary between the inner core layer and the outer core layer, (c) represent the JIS-C cross-sectional hardness of the outer core layer 1 mm outside the boundary, and (d) represent the JIS-C surface hardness of the outer core layer, the value (c)-(b) is in a range of from −15 to 10 and the value (d)-(b) is in a range of from −10 to 20.

2. The multi-piece solid golf ball of claim 1, wherein the inner core layer is formed primarily of a resin composition obtained by mixing:

100 parts by weight of a base resin of (A-I) from 100 to 30 wt % of an olefin-unsaturated carboxylic acid-unsaturated carboxylic acid ester random terpolymer and/or a metal salt thereof and (A-II) from 0 to 70 wt % of an olefin-unsaturated carboxylic acid random copolymer and/or a metal salt thereof, (B) from 5 to 170 parts by weight of a fatty acid or fatty acid derivative having a molecular weight of from 280 to 1500, and (C) from 0.1 to 10 parts by weight of a basic inorganic metal compound capable of neutralizing acid groups within components A and B.

3. The multi-piece solid golf ball of claim 1, wherein the polybutadiene rubber used in the outer core layer rubber composition is synthesized with a rare-earth catalyst.

4. The multi-piece solid golf ball of claim 1, wherein the outer core layer rubber composition includes an organic peroxide having a half-life at 155° C. of from 5 to 120 seconds in an amount of from 0.2 to 3 parts by weight per 100 parts by weight of the base rubber.

* * * * *

UNITED STATES PATENT AND TRADEMARK OFFICE

CERTIFICATE OF CORRECTION

PATENT NO. : 7,938,744 B2
APPLICATION NO. : 12/393086
DATED : May 10, 2011
INVENTOR(S) : Junji Umezawa et al.

It is certified that error appears in the above-identified patent and that said Letters Patent is hereby corrected as shown below:

At column 15, please amend TABLE 2 of the above referenced patent as follows:

TABLE 2

| | Ingredient | No. 1 | No. 2 | No. 3 | No. 4 | No. 5 | No. 6 | No. 7 |
|---|---|---|---|---|---|---|---|---|
| Nucrel AN4319 | A-I | 75 | | ~~46~~40 | | 75 | | |
| Nucrel N035C | A-I | | 40 | | | | | |
| Surlyn 6320 | A-I | | 60 | | | | | |
| Nucrel N1560 | A-II | 25 | | | | 25 | | |
| Escor 5100 | A-II | | | 60 | | | | |
| Surlyn 8940 | A-II | | | | | | 50 | |
| Surlyn 9945 | A-II | | | | | | 50 | |
| Himilan 1605 | A-II | | | | 69 | | | |
| Dynaron 6100P | | | | | 31 | | | |
| Pandex T8290 | | | | | | | | 25 |
| Pandex T8295 | | | | | | | | 75 |
| Oleic acid | B | 25 | | | | 25 | | |
| Magnesium stearate | B | | 69 | 100 | | | 1.7 | |
| Behenic acid | B | | | | 18 | | | |
| Calcium hydroxide | C | | | | 2.3 | | | |
| Magnesium oxide | C | 3.6 | 0.8 | 2.8 | | 3.6 | | |
| Barium sulfate | | | | | | 18 | | |
| Polytail H | | | | | 2 | | | |
| Polyisocyanate compound | | | | | | | | 9 |
| Thermoplastic elastomer | | | | | | | | 15 |
| Titanium oxide | | | | | | | 2.8 | 3.5 |
| Polyethylene wax | | | | | | | 1 | 1.5 |

Ingredient amounts shown above are in parts by weight

Signed and Sealed this
Twenty-fifth Day of October, 2011

David J. Kappos

David J. Kappos
*Director of the United States Patent and Trademark Office*

At column 18, please amend TABLE 3 of the above referenced patent as follows:

TABLE 3

| | | | Example | | | | | | |
|---|---|---|---|---|---|---|---|---|---|
| | | | 1 | 2 | 3 | 4 | 5 | 6 | 7 |
| Inner core layer | Material | Type | No. 1 | No. 1 | No. 2 | No. 3 | No. 1 | No. 1 | No. 1 |
| | Diameter | (mm) | 23.4 | 23.4 | 23.4 | 23.4 | 29.2 | 23.4 | 23.4 |
| | Weight | (g) | 6.3 | 6.3 | 6.3 | 6.3 | 12.2 | 6.3 | 6.3 |
| | Center cross-section Hardness | JIS-C | 76 | 76 | 80 | 79 | 76 | 76 | 76 |
| | Cross-sectional hardness 1 mm inside inner/outer layer interface (b) | JIS-C | 77 | 77 | 81 | 79 | 77 | 77 | 77 |
| Outer core layer | Formulation | Type | C | D | E | E | F | G | H |
| | Diameter | (mm) | 37.3 | 36.5 | 36.5 | 36.5 | 38.3 | 37.3 | 36.5 |
| | Thickness | (mm) | 7.0 | 6.6 | 6.6 | 6.6 | 4.6 | 7.0 | 6.6 |
| | Cross-sectional hardness 1 mm outside inner/outer layer interface (c) | JIS-C | 75 | 74 | 72 | 72 | 67 | 70 | 67 |
| | Surface hardness (d) | JIS-C | 81 | 81 | 79 | 79 | 74 | 77 | 74 |
| | (c) - (b) | JIS-C | -2 | -3 | -9 | -7 | -10 | -7 | -10 |
| | (d) - (b) | JIS-C | +4 | +4 | -2 | 0 | -3 | 0 | -3 |
| ~~Intermediate layer~~Inner cover layer | Material | Type | No. 2 | No. 4 | No. 4 | No. 4 | No. 4 | No. 2 | No. 4 |
| | Hardness | Shore D | 51 | 56 | 56 | 56 | 56 | 51 | 56 |
| | Diameter | (mm) | 40.0 | 40.7 | 40.7 | 40.7 | 40.7 | 40 | 40.7 |
| | Thickness | (mm) | 1.4 | 2.1 | 2.1 | 2.1 | 1.2 | 1.7 | 2.1 |
| ~~Cover~~Outer cover layer | Material | Type | No. 6 | No. 7 | No. 7 | No. 7 | No. 7 | No. 6 | No. 7 |
| | Hardness | Shore D | 62 | 54 | 54 | 54 | 54 | 62 | 54 |
| | Thickness | (mm) | 1.4 | 1.0 | 1.0 | 1.0 | 1.0 | 1.4 | 1.0 |
| Ball | Diameter | (mm) | 42.7 | 42.7 | 42.7 | 42.7 | 42.7 | 42.7 | 42.7 |
| | Weight | (g) | 45.5 | 45.5 | 45.5 | 45.5 | 45.5 | 45.5 | 45.5 |
| | Deformation (10-130 kg) | (mm) | 2.7 | 2.7 | 2.7 | 2.8 | 2.7 | 3.0 | 3.0 |
| W#1 HS 50 | Initial velocity | (m/s) | 72.9 | 73.0 | 73.0 | 72.9 | 73.1 | 72.4 | 72.5 |
| | Carry | (m) | 243.9 | 244.0 | 243.4 | 242.7 | 243.8 | 242.2 | 241.8 |
| | Total | (m) | 261.7 | 260.8 | 260.6 | 260.0 | 260.6 | 260.0 | 259.2 |
| | Feel on impact | | good | good | good | good | good | good | good |

At column 19, please amend TABLE 4-continued of the above reference patent as follows:

TABLE 4-continued

| | | | Comparative Example | | | | |
|---|---|---|---|---|---|---|---|
| | | | 1 | 2 | 3 | 4 | 5 |
| Outer core layer | Formulation | Type | — | I | K | K | L |
| | Diameter | (mm) | — | 36.5 | 36.5 | 36.5 | 41.0 |
| | Thickness | (mm) | — | 6.6 | 6.6 | 6.6 | 1.3 |
| | Cross-sectional hardness 1 mm outside inner/outer layer interface (c) | JIS-C | — | 75 | 65 | 65 | 65 |
| | Surface hardness (d) | JIS-C | — | 82 | 72 | 72 | 72 |
| | (c) - (b) | JIS-C | — | +2 | -16 | -22 | -12 |
| | (d) - (b) | JIS-C | — | +9 | -9 | -15 | -5 |
| ~~Intermiediate Layer~~Inner cover layer | Material | Type | No. 4 | No. 4 | No. 4 | No. 4 | none |
| | Hardness | Shore D | 56 | 56 | 56 | 56 | — |
| | Diameter | (mm) | 40.7 | 40.7 | 40.7 | 40.7 | — |
| | Thickness | (mm) | 2.1 | 2.1 | 2.1 | 2.1 | — |
| ~~Cover~~ Outer cover layer | Material | Type | No. 7 | No. 7 | No. 7 | No. 7 | No. 7 |
| | Hardness | Shore D | 54 | 54 | 54 | 54 | 54 |
| | Thickness | (mm) | 1.0 | 1.0 | 1.0 | 1.0 | 0.85 |
| Ball | Diameter | (mm) | 42.7 | 42.7 | 42.7 | 42.7 | 42.7 |
| | Weight | (g) | 45.5 | 45.5 | 45.5 | 45.5 | 45.5 |
| | Deformation (10-130 kg) | (mm) | 3.0 | 3.0 | 3.2 | 2.45 | 2.3 |
| W#1 | Initial velocity | (m/s) | 72.0 | 71.8 | 72.3 | 73.5 | 73.7 |
| HS50 | Carry | (m) | 240.0 | 238.9 | 239.9 | 242.7 | 242.6 |
| | Total | (m) | 257.5 | 257.7 | 258.0 | 256.1 | 255.2 |
| | Feel on impact | | good | good | good | NG | NG |